US007086096B1

(12) United States Patent
Montero

(10) Patent No.: US 7,086,096 B1
(45) Date of Patent: Aug. 8, 2006

(54) MOTORCYCLE HELMET WINDSHIELD CONTROL SYSTEM AND METHOD

(76) Inventor: Fabián Montero, C/ Lirio, 23 - Cobella, 28863, Madrid (ES)

( * ) Notice: Subject to any disclaimer, the term of this patent is extended or adjusted under 35 U.S.C. 154(b) by 143 days.

(21) Appl. No.: 10/723,532

(22) Filed: Nov. 26, 2003

(51) Int. Cl.
*A42B 1/08* (2006.01)

(52) U.S. Cl. ..... 2/424; 2/906; 340/432

(58) Field of Classification Search ..... 2/410, 2/424, 906, 6.6, 6.4, 6.5, 425, 6.3; 340/432
See application file for complete search history.

(56) References Cited

U.S. PATENT DOCUMENTS

| | | | | |
|---|---|---|---|---|
| 4,546,498 | A * | 10/1985 | Fantin | 2/424 |
| 5,072,209 | A | 12/1991 | Hori et al. | 340/432 |
| 5,297,297 | A * | 3/1994 | Pei | 2/424 |
| 5,315,289 | A | 5/1994 | Fuller et al. | 340/532 |
| 5,704,707 | A | 1/1998 | Gebelein et al. | 362/106 |
| 6,370,700 | B1 | 4/2002 | Arion | 2/424 |
| 6,720,870 | B1 | 4/2004 | Morse | 340/468 |
| 6,861,970 | B1 | 3/2005 | Garland | 342/20 |
| 6,877,169 | B1 * | 4/2005 | Acquaviva | 2/429 |

FOREIGN PATENT DOCUMENTS

| | | | |
|---|---|---|---|
| CA | 2124780 | A1 * | 12/1995 |
| FR | 2610484 | A1 * | 8/1988 |

* cited by examiner

*Primary Examiner*—Rodney M. Lindsey
(74) *Attorney, Agent, or Firm*—Haverstock & Owens LLP

(57) ABSTRACT

A motorcycle windshield control system is disclosed. The system includes a receiver and filter circuit coupled to a motorcycle helmet having a windshield for receiving and filtering electromagnetic signals generated by an electrical device of a motorcycle. Alternatively, the receiver and filter circuit can receive signals emitted by an emitter installed on the motorcycle. The system also includes a control circuit coupled to the receiver and filter circuit, for performing a Boolean operation to activate a raiser motor for adjusting a position of the windshield when the Boolean operation generates a high logic level. The system can also include a manual override switch.

15 Claims, 3 Drawing Sheets

MOTORCYCLE HELMET WINDSHIELD CONTROL SYSTEM AND METHOD

FIELD OF THE INVENTION

This invention relates generally to a mechanism and apparatus for controlling a helmet windshield. More specifically, this invention relates to a mechanism and apparatus for automatically adjusting a position of a helmet windshield such that the windshield automatically opens up during stopped periods and closes down when restarting motion occurs.

BACKGROUND OF THE INVENTION

A motorcycle helmet provides safety to a motorcycle driver. Most helmets are equipped with a windshield or face shield. A helmet's windshield protects the face of the driver against flying debris, rain, wind, and insects while driving a motorcycle.

During stopped periods, e.g. at traffic lights, a closed helmet can be uncomfortable for a driver, especially under certain weather conditions. Helmets can get extremely warm and foggy at stopped periods in hot weather. To obtain relief, the driver manually opens the windshield at stopped periods and then manually closes the windshield before driving off. This sequence may be repeated at each stopped period, which can inconvenience and/or delay the driver.

What is needed is a helmet whose windshield automatically open up during stopped periods and closes down when restarting motion occurs.

BRIEF SUMMARY OF THE INVENTION

In accordance with an embodiment of the present invention, an apparatus is disclosed. The apparatus comprises a helmet for use with a motorcycle; a windshield coupled to the helmet; and means for automatically adjusting a position of the windshield when a speed of the motorcycle crosses a predetermined threshold value. The apparatus can include a manual override switch coupled to the helmet so that a user can manually adjust the windshield to a desired position.

The means for automatically adjusting can comprise a control circuit for receiving a plurality of signals to perform a Boolean operation. The control circuit comprises a three-input Boolean And gate. The position of the windshield is adjusted when the Boolean operation generates a high logic level. The position of the windshield can be adjusted by temporarily releasing a pawl from a rod and activating a raiser motor to reach a new windshield position. The rod preferably maintains the windshield at its current position.

The apparatus can further include a power supply coupled to the control circuit for supplying power to the raiser motor. The power supply can comprise one or more batteries. Alternatively, the power supply can comprise one or more solar cells.

In an alternative embodiment of the present invention, a mechanism for a helmet windshield of a motorcycle is disclosed. The mechanism comprises means for automatically adjusting a position of the windshield when a speed of the motorcycle crosses a predetermined threshold value.

In another embodiment of the present invention, a motorcycle windshield control system is disclosed. The system includes a receiver and filter circuit coupled to a motorcycle helmet having a windshield for receiving electromagnetic signals generated by an emitter circuit positioned on a motorcycle. The receiver and filter circuit rejects signals other than from the emitter circuit of the motorcycle and generates electrical signals. The system further includes a control circuit for receiving a plurality of signals to perform a Boolean operation.

The emitter circuit is preferably coupled to a wheel rotation detection circuit for detecting the speed of the motorcycle. The detection circuit sends a digital signal to the emitter circuit when the speed of the motorcycle crosses a predetermined threshold value. The detection circuit can be a sensor.

In another embodiment of the present invention, a motorcycle helmet windshield control system is disclosed. The system includes an a receiver and filter circuit coupled to a motorcycle helmet having a windshield for receiving electromagnetic signals generated by an electrical device of a motorcycle. The receiver and filter circuit rejects signals other than from the electrical device and generates electrical signals. The system further includes a control circuit for receiving a plurality of signals to perform a Boolean operation.

In another embodiment of the present invention, a method is disclosed. The method comprises the steps of providing a helmet for use with a motorcycle; providing a windshield coupled to the helmet; and providing means for automatically adjusting a position of the windshield when the speed of the motorcycle crosses a predetermined threshold value.

In another embodiment of the present invention, a method of automatically adjusting a position of a helmet windshield for use with a motorcycle is disclosed. The method comprises the step of receiving electromagnetic signals generated by an electrical device of the motorcycle. The method also includes the step of filtering the generated electromagnetic signals. The method further comprises the step of performing a Boolean operation to activate a raiser motor to adjust the position of the helmet windshield when the Boolean operation generates a high logic level.

In another embodiment of the present invention, a method of automatically adjusting a position of a helmet windshield for use with a motorcycle is disclosed. The method comprises the step of receiving electromagnetic signals emitted by an emitter circuit installed on the motorcycle. The method also comprises the step of filtering the emitted electromagnetic signals. The method further comprises the step of performing a Boolean operation to activate a raiser motor to adjust the position of the helmet windshield when the Boolean operation generates a high logic level.

DETAILED DESCRIPTION OF THE INVENTION

Reference will now be made in detail to the preferred and alternative embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it should be noted that the present invention may be practiced without these specific details. In other instances, well known methods, procedures and components have not been described in detail as not to unnecessarily obscure aspects of the present invention.

Figure 1:
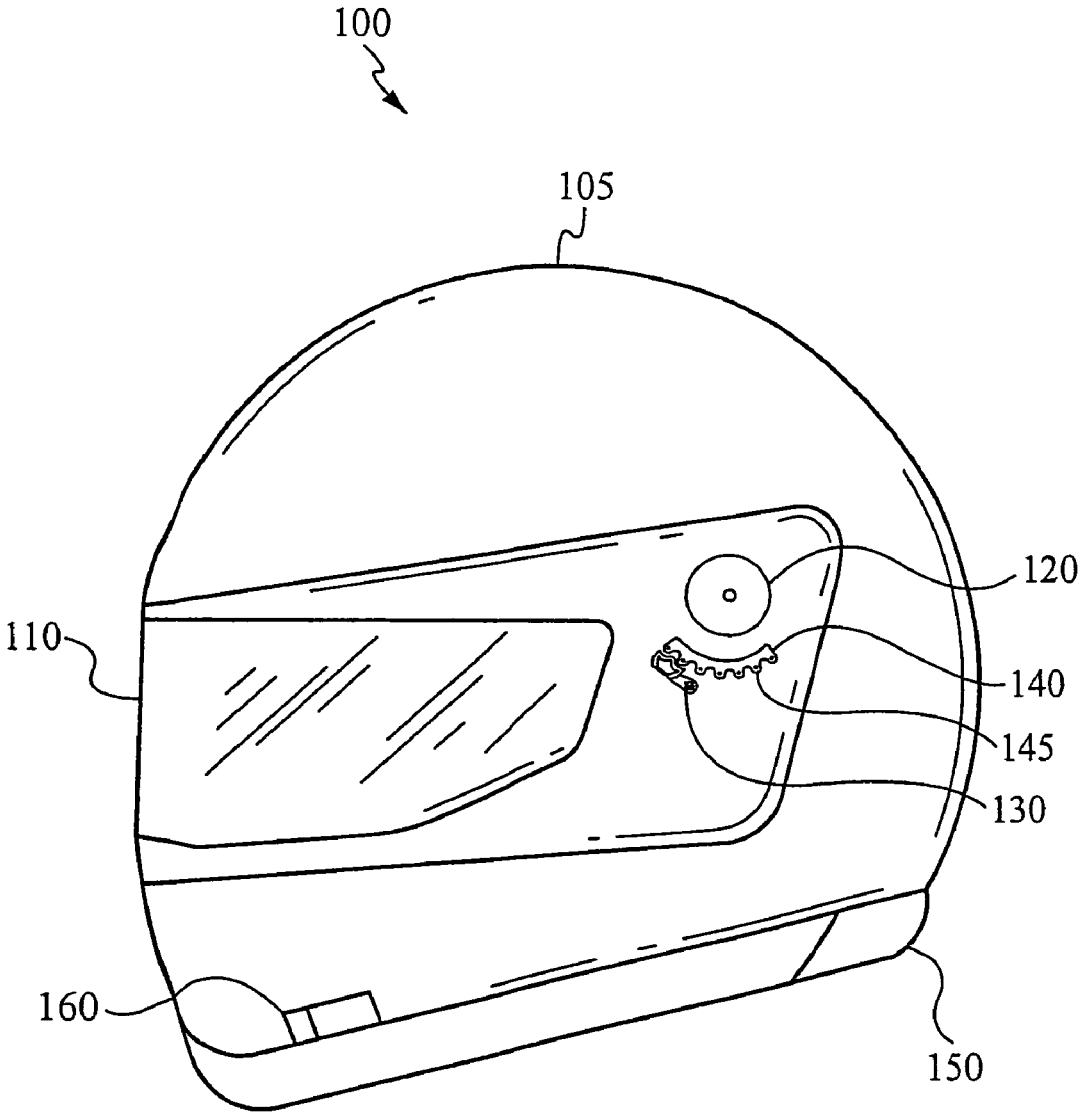
FIG. 1 illustrates a side view of an apparatus for controlling a motorcycle helmet windshield.

Referring now to the drawings and particularly to FIG. 1, there is shown one embodiment of an apparatus 100 for controlling a motorcycle helmet windshield. The apparatus 100 includes a helmet 105 for use with a motorcycle and a windshield or shield 110 coupled to the helmet 105. The helmet can be made of fiberglass, Kevlar, or a polycarbonate mixture. The helmet can also include an optional chin strap. The shield can be made of clear or tinted optical-quality polycarbonate or any shatter-proof material. The apparatus further includes means for automatically adjusting a position of the shield 110 when a speed of the motorcycle crosses a predetermined threshold. The mean for automatically adjusting can be an automatic control system 120. The automatic control system 120, as will be explained in more detail below with the block diagram of FIG. 3, can sense electromagnetic signals from an electrical device of the motorcycle, such as a spark plug, or a device installed on the motorcycle, such as an emitter circuit, and automatically and appropriately position the shield 110 of the helmet 105, such that the shield 110 automatically opens during stopped periods and closes down during driving periods. The apparatus 100 also includes a pawl and pawl release mechanism 130 mounted to the shield 110 for movement between opened and closed positions relative to teeth 145 of a rigid rod 140 and a batteries compartment 150, for housing batteries, to supply power to the automatic control system 120. The batteries are preferably rechargeable. In an alternative embodiment, the helmet 105 can include solar power collectors which are preferably incorporated into an upper surface of the helmet 105 for charging the batteries. The apparatus 100 also includes a selector switch 160, which can be a manual override switch, coupled to the helmet 105 so that a user can manually adjust the windshield 110 to a desired position or disable the invention such as during cold or inclement weather.

Figure 2:
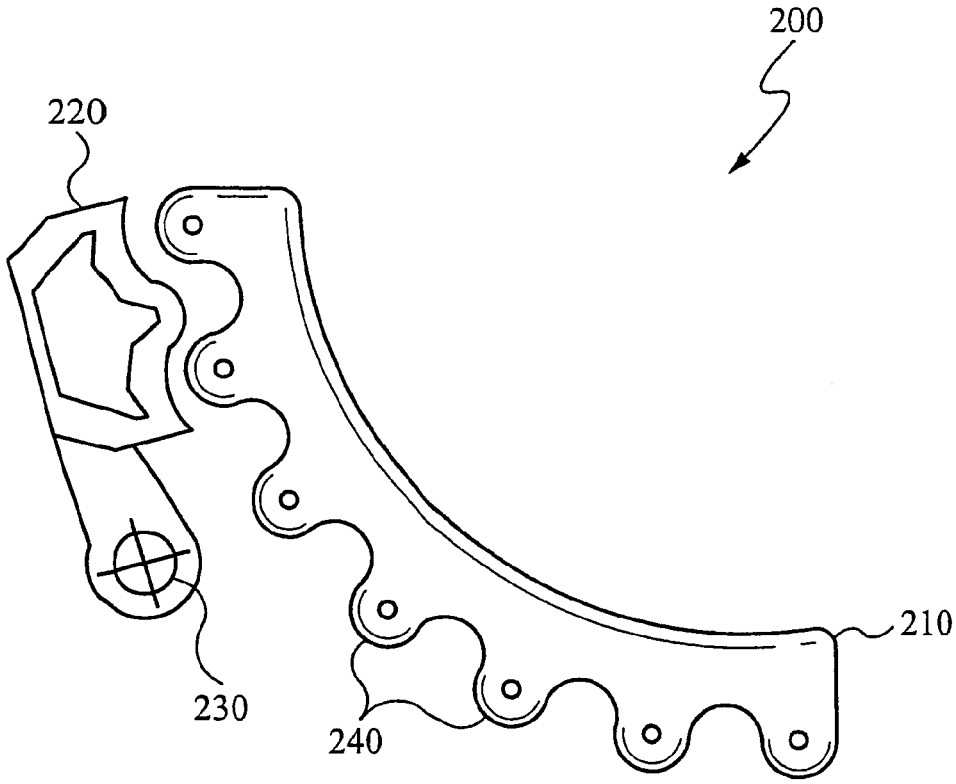
FIG. 2 illustrates a schematic diagram of a pawl and rod arrangement in accordance with the present invention.

FIG. 2 is a schematic diagram of a pawl and rod arrangement 200 in accordance with the present invention. A pawl 220 is mounted on the helmet 105 (FIG. 1) and engageably coupled to a rod 210 having a plurality of teeth 240 for movement relative to the rod 210. A pawl release 230 is attached to the pawl. The pawl release 230 provides a mechanism for disengaging the pawl from the teeth, thereby allowing unrestricted movement between opened and closed positions of the shield. When the pawl release 230 receives a signal to change a position of the shield, the pawl release releases the pawl from the rod and allows the pawl to move to a new position on the rod 210 as the shield 110 (FIG. 1) moves.

Figure 3:
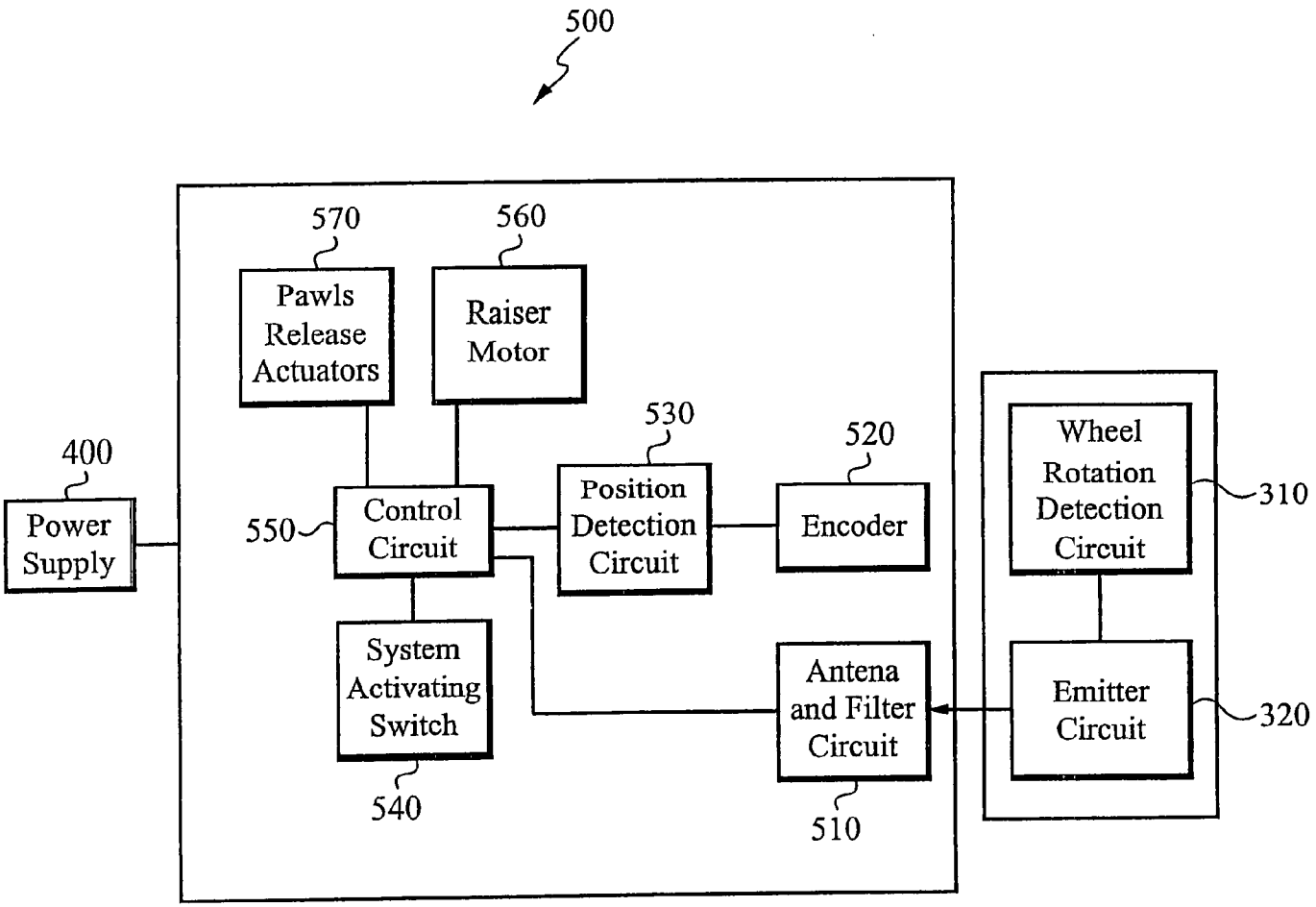
FIG. 3 illustrates a block diagram of an automatic control system for adjusting a position of a helmet windshield for use with a motorcycle.

FIG. 3 is a block diagram of an automatic control system 500 for adjusting a position of a helmet windshield for use with a motorcycle. The control system 500 is coupled to a power supply 400 for supplying power to a raiser motor 560 of the control system 500. The control system also includes a pawl release actuator 570 which is electrically coupled to the pawl and rod arrangement of FIG. 2, a system activating switch 540 to provide manual override of the system 500, a position detection circuit 530 which corresponds to a current position of the windshield, and an antenna and filter circuit 510 for receiving and filtering electromagnetic signals generated from a device(s) or circuit(s) of the motorcycle. The position detection circuit 530 can be coupled to an encoder 520 for detecting the position of the windshield. The system activating switch 540, the position detection circuit 530 and the antenna and filter circuit 510 can all send signals to a control circuit 550, which will be discussed more fully below.

The antenna and filter circuit 510 receives electromagnetic signals generated by an emitter circuit 320 of a motorcycle and rejects emissions other than from the emitter circuit 320 of the motorcycle. Alternatively, the antenna and filter circuit 510 can receive electromagnetic signals from an electrical device (not shown) of the motorcycle. The electrical device (not shown) can be a spark plug. The emitter circuit 320 is coupled to a wheel rotation detection circuit 310 for detecting the speed of the motorcycle. The detection circuit 310 sends a digital signal to the emitter circuit 320 when the speed of the motorcycle crosses a predetermined threshold value. The predetermined threshold value can be in units of revolutions per minute (RPM). The detection circuit 310 can be a sensor. Once the electromagnetic signals are received and filtered by the antenna and filter circuit 510, an electrical signal (or signals) is sent to the control circuit 550 for receiving a plurality of signals to perform a Boolean operation.

The control circuit 550 comprises a three-input Boolean And gate. The control circuit 550 receives the plurality of signals from the antenna and filter circuit 510, the position detection circuit 530 and the system activating switch 540, to perform the Boolean operation. The position of the windshield is adjusted when the Boolean operation generates a high logic level. In other words, each signal or signals sent by the circuits 510 and 530 and the switch 540 must be in a high logic level, for example 5V rather than 0 V, before the control circuit 550 can activate the actuator 570 and the motor 560 to adjust the position of the windshield. When the control circuit 550 generates a high logic level, a change of position of the shield is automatically activated by temporarily releasing the pawl 220 (FIG. 2) from the rod 210 (FIG. 2) via a pawl release actuator 570, which maintains the shield at its last position, and activating the motor 560 to cause the pawl release 230 (FIG. 2) to move the pawl 220 (FIG. 2) to a new position on the rod 210.

The circuit can include a timer when the circuit 320 is configured to trigger off electromagnetic signals such as spark plug noise. When a motorcycle rider is stopped and the engine is idling, the shield 110 (FIG. 1) will rise. If the rider briefly revs the engine it is desired that the shield 110 (FIG. 1) remain up. The timer would only lower the shield 110 (FIG. 1) after a sustained increase in engine speed, such as more than two seconds. It will be appreciated that the preferred Boolean operation is representative only and that any other Boolean function can be used.

Variations of the above-described embodiments are contemplated and readily appreciable to one skilled in the art. For example, the control circuit 550 can include a memory chip for storing data including speed versus time information of the motorcycle, histogram information, average speed information, and the number of stopped periods. The memory chip can apply a data compression algorithm for compressing the stored data to conserve memory resources. In other embodiments, the control system 500 can include an interface circuit with specific software to interface with a personal computer for downloading and analyzing the data via a connector and setting up the threshold values at which the detection circuit 310 sends a digital signal to the emitter circuit 320. The connector can be a Universal Serial Bus (USB) port. The connector can also be a wireless transceiver or a PC Card interface.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made to the embodiments chosen for illustration without departing from the spirit and scope of the invention.

What is claimed is:

1. An apparatus, comprising:

a. a helmet;

b. a windshield coupled to the helmet; and c. means for automatically adjusting a position of the windshield when a speed of a vehicle crosses a predetermined threshold value.

2. The apparatus of claim 1, wherein the predetermined threshold value is in units of spark plug ignition.

3. The apparatus of claim 1, wherein the predetermined threshold value is in units of revolutions per minute (RPM).

4. The apparatus of claim 1, wherein the means for automatically adjusting comprises a control circuit for performing a Boolean operation.

5. The apparatus of claim 4, further including a power supply coupled to the control circuit for supplying power to the means for automatically adjusting.

6. The apparatus of claim 1, further including a manual override switch coupled to the helmet wherein the manual override switch overrides the means for automatically adjusting the position of the windshield so that a user can manually adjust the windshield to a desired position.

7. A mechanism for a helmet windshield of a motorcycle, comprising means for automatically adjusting a position of the windshield when a speed of the motorcycle crosses a predetermined threshold value.

8. The mechanism of claim 7, wherein the threshold value is in units of spark plug ignition.

9. The mechanism of claim 7, wherein the threshold value is in units of revolutions per minute (rpm).

10. A motorcycle helmet windshield control system, comprising:

a. a receiver and filter circuit coupled to a motorcycle helmet having a windshield configured to receive electromagnetic signals generated by a spark plug of a motorcycle and for generating electrical signals; and b. a control circuit coupled to the receiver and filter circuit for receiving electrical signals to perform a Boolean operation, such that a position of the windshield is automatically adjusted in response to the Boolean operation.

11. The system of claim 10, further including a manual override switch coupled to the helmet so that a user can manually adjust the windshield to a desired position, wherein the manual override switch sends an override signal to the control circuit.

12. The system of claim 10, further including a position detection circuit coupled to the control circuit for detecting the position of the windshield and sending a detection signal to the control circuit.

13. A method, comprising the steps of:

a. providing a helmet for use with a motorcycle;

b. providing a windshield coupled to the helmet; and c. providing means for automatically adjusting a position of the windshield when the speed of the motorcycle crosses a predetermined threshold value.

14. A method of automatically adjusting a position of a helmet windshield for use with a motorcycle, the method comprising the steps of:

a. receiving electromagnetic signals generated by a spark plug of the motorcycle; and b. generating electrical signals to perform a Boolean operation to activate a raiser motor for automatically adjusting the position of the helmet windshield in response to the Boolean operation.

15. A system for controlling a motorcycle helmet windshield, comprising:

a. a helmet;

b. a windshield coupled to the helmet;

c. means for detecting a speed of a vehicle and for transmitting a signal when the speed of the vehicle crosses a predetermined threshold; and c. means for receiving the signal and adjusting a position of the windshield in response to the signal.

* * * * *